United States Patent [19]

Pollock et al.

[11] 4,090,870

[45] May 23, 1978

[54] CONTINUOUS SMELTING AND REFINING OF CEMENT COPPER

[75] Inventors: Douglas Pollock; Omar Sobarzo; Rolando Urquizar; Carlos Vilches; Jaime Bolanos, all of Santiago, Chile

[73] Assignee: Compania de Acero del Pacifico S.A., Santiago, Chile

[21] Appl. No.: 758,570

[22] Filed: Jan. 12, 1977

Related U.S. Application Data

[62] Division of Ser. No. 700,217, Jun. 28, 1976, Pat. No. 4,056,262.

[51] Int. Cl.[2] ..... C22B 15/00

[52] U.S. Cl. ..... 75/74; 75/76; 266/138

[58] Field of Search ..... 75/72, 74, 76; 266/141, 266/159, 161, 175, 138

[56] References Cited

U.S. PATENT DOCUMENTS

| | | | |
|---|---|---|---|
| 234,384 | 6/1883 | Colleau | 266/159 |
| 711,173 | 10/1902 | McKechnig | 266/175 |
| 1,198,434 | 9/1916 | Garred | 75/76 |
| 2,194,454 | 3/1940 | Greenwalt | 266/175 |
| 2,746,858 | 5/1956 | Schneible | 266/141 |
| 3,490,899 | 1/1970 | Krivsky et al. | 75/72 |
| 3,892,559 | 7/1975 | Quarm | 75/72 |

*Primary Examiner*—Walter R. Satterfield
*Attorney, Agent, or Firm*—James J. Burke

[57] ABSTRACT

Use of a shaft kiln in continuous smelting and refining of cement copper is made possible with a mix preheater, a refined gas preheater, an air preheater, an air mix feeder and forehearths for cement oxidation and reduction, and wherein oxidation is achieved by injecting oxidant gases and reduction by injecting preheated petroleum gas, subsequent to having placed a layer of charcoal on the smelt.

12 Claims, 3 Drawing Figures

CONTINUOUS SMELTING AND REFINING OF CEMENT COPPER

This is a division of application Ser. No. 700,217 filed June 28, 1976, now U.S. Pat. No. 4,056,262, issued Nov. 1, 1977 and titled "CUPOLA FURNACE TO ENABLE CONTINUOUS SMELTING AND REFINING OF CEMENT COPPER AND METHOD THEREFOR."

BACKGROUND OF THE INVENTION

In the art of extractive metallurgy, "cement copper" is the term used to identify the product obtained by precipitating copper from solutions, generally with added iron as precipitant. There is no known method to continuously firesmelt and refine cement copper to produce metallic copper with a purity similar to that resulting from electrolytic methods, e.g. 99.9%. Conventional methods used industrially are very complex; a reverberatory furnace is charged with sulfide concentrates of low purity, 40% to 48%, the smelting of which produces a matte consisting of double copper and iron sulfide, with a 45% to 55% Cu content. This matte is loaded into a converter, wherein it is oxidized with air or oxygen to obtain 98.5% Cu blister copper. This blister copper is then fire refined, cast into anodes, and refined electrolytically to produce 99.9% Cu cathodes.

No commercially known process is known for the continuous smelting and refining of cement copper, in such a way to permit full use of its original high purity.

The present invention is directed to a method for obtaining metallic copper with a purity of 99.9% by direct fire smelting and refining of cement copper in a specially designed shaft kiln in a single, continuous operation. The present invention is advantageously employed in conjunction with the continuous, high-purity process for producing granular cement copper described in U.S. Pat. No. 3,874,940, assigned to the same assignee as the instant application.

The shaft kiln is a vertical furnace traditionally used for smelting iron, scrap iron or pig iron, and which is provided with nozzles or tuyeres at its lower end. It uses metallurgical coke as fuel and its interior carries a lining of refractory material. Such a kiln has three main parts:

(a) The lower section or hearth of the kiln, where the smelt metal descending from the charge in the shaft is collected. This part is provided with a lower outlet or tap to allow outflow of the melt.

(b) The intermediate section, situated immediately above the hearth is the area of the kiln exhibiting the highest temperature, and at its lower end are the tuyeres and wind boxes, through which air is blown in.

(c) The highest section of the kiln, above the midsection, is where the loading gates or chutes are situated to receive the ore, coke, and flux.

In order to smelt metal, the shaft kiln uses the heat irradiated by an incandescent coke column that is permeable to gases. It is provided with combustion ignition and maintaining systems, and air is blown in through the tuyeres. Coke and iron scrap or whatever are loaded through the charging gates in alternate layers that descend progressively to the intermediate section to the extent that the fuel is consumed, and the metal completes smelting at this area of higher temperature. The smelt metal drips through the incandescent coke and deposits itself on the hearth.

It is impossible to smelt cement copper in a conventional shaft kiln, because on loading the cement through the upper gates, it is drawn by the gas current originating in the combustion zone and blown out of the furnace. Nor is it possible to load intermittently significant amounts of cement, because its fine granulation obstructs the permeability of the incandescent column, causing the kiln to extinguish. Although in theory briquetted cement copper could be loaded alternatively with the coke, in practice this is not practical because the added cost of manufacturing briquettes raises costs to noncommercial levels.

The present invention provides for loading the cement mixed with flux directly to the intermediate section of the shaft kiln, avoiding the indicated inconveniences of loading through the upper gates, and without obstructing the normal operation of the kiln. To this effect, specific improvements on the conventional shaft kiln have been designed, enabling cement copper smelting and refining to be carried out in a continuous process.

OBJECTS OF THE INVENTION

A general object of the present invention is to provide an improved shaft kiln for smelting and refining of cement copper.

Another object of the present invention is to provide an improved method for smelting and refining of cement copper.

A still further object of the present invention is to provide a method for the continuous fire refining of cement copper.

Various other objects and advantages of the invention will become clear from the following description of embodiments, and the novel features will be particularly pointed out in connection with the appended claims.

THE DRAWINGS

Reference will hereinafter be made to the accompanying drawings, wherein.

DESCRIPTION OF EMBODIMENTS

Figure 1:
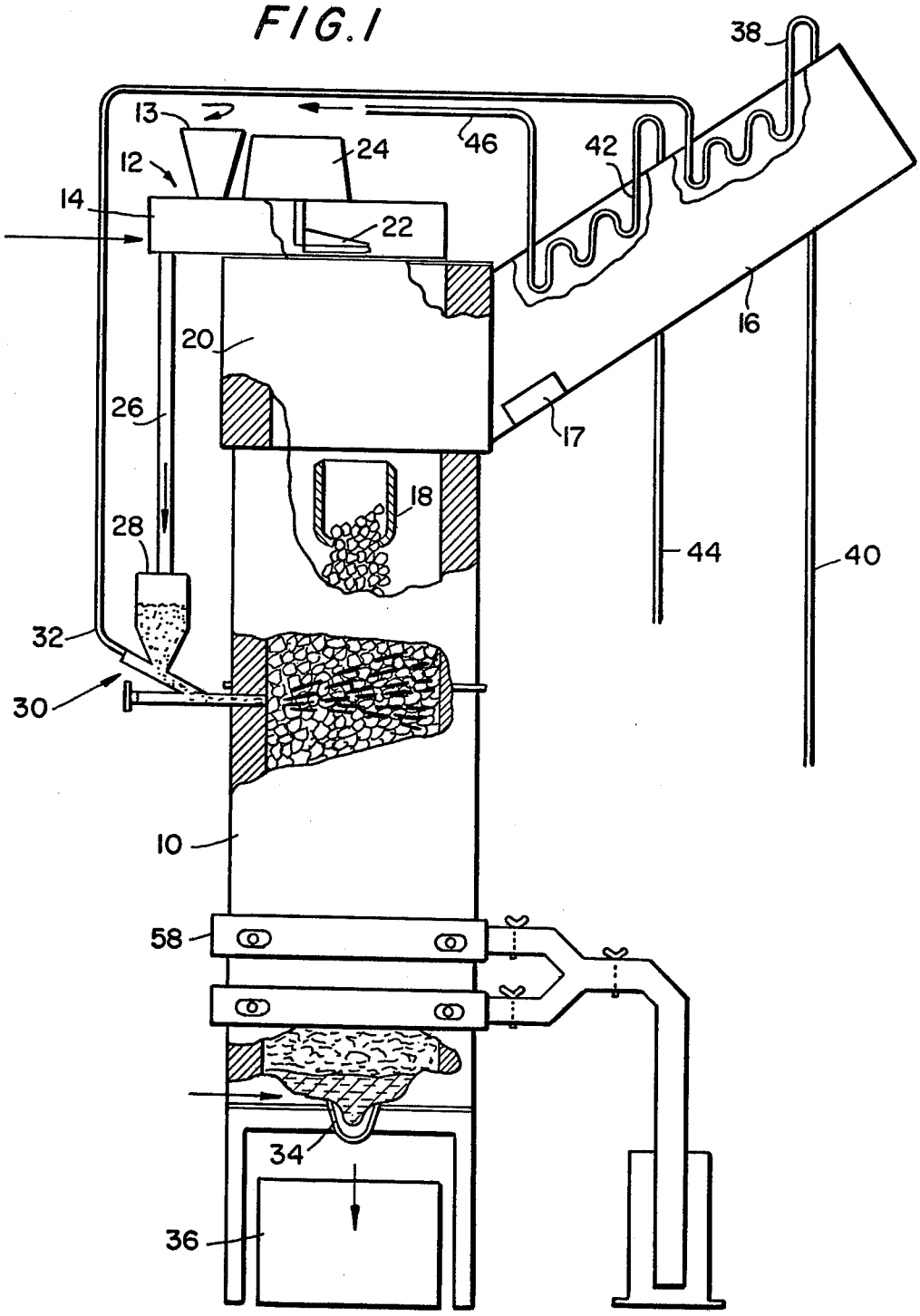
FIG. 1 is a side elevation view, partly in section, of a shaft kiln in accordance with the invention.

As shown in FIG. 1, the invention contemplates supplementing a conventional kiln 10 with a mix preheater 12 having a metal tray 14 that is placed on the upper part and over the kiln 10. This tray is indirectly heated by the ascending stream of hot gases produced by combustion inside the kiln. Combustion gases flow through an oblique lateral shaft 16 protruding out the side of the kiln, immediately under the base of tray 14. Coke is loaded through a gate 18 situated on the side of the kiln, immediately under the upper gas chamber 20, from where the oblique shaft 16 originates.

Cement copper and fluxes are loaded onto the tray 14 through hopper 13. The mix is homogenized by means of a mixing pallet or rabble 22 propelled by a conventional motor located in the box 24. Tests have shown that the mix reaches a suitable temperature in the preheater for the purpose of this invention as described hereinbelow. The mix is unloaded continuously through the down pipe 26 into the hopper of an air feeder 30 upon being pushed therein by the mixing pallet 22.

Air mix feeder 30 comprises the receiving hopper 28 into which the mix drops from the tray 14 through the down pipe 26, and has a conical base connected to the pipe 32 that penetrates into the inside of kiln 10. Hot air is carried by the pipe 32 and carries the mix that falls into the same tube from hopper 28. The location of feeder 30 is important, and should be about 45–50% of the shaft height. If the mix is fed too high, cement will be blown out; if the feeder is too low, unmelted cement will reach the hearth. The mix is dispersed in the column of incandescent coke and it smelts rapidly and drops in a liquid state into the kiln hearth, from which it continuously descends down the outlet 34 to the forehearth 36 situated directly under it.

Oblique lateral shaft 16 carries the outflow of combustion gases from the gas chamber 20 placed immediately under the metal tray 14. The shaft dimensions are conventionally established in relation to the characteristics of the kiln and it has an inclination of between 30° and 45°, to facilitate collection of any fines therein and their return to the shaft by gravity, or removal through gate 17.

To effect the heating of air blown into the air feeder through the tube 32, a coil 38 is set up inside the shaft 16, the dimensions of which are determined conventionally under the specifications for the desired operation. Air is blown in by means of a conventional compressor (not shown) through a pipe 40, heated in the coil 38 by the latent heat of gases leaving through the shaft 16, and carried hot by pipe 32 to air feeder 30. A second coil 42 is placed inside shaft 16 to heat the previously-gasified liquified petroleum gas supplied under pressure through pipe 44. The dimensions of the coil are determined conventionally under the specifications of the desired operation. The hot natural gas leaves under pressure through pipe 46 and is carried by conventional means to the forehearth 36 for use in reducing the metal. The gas is heated in order to secure a more effective reduction in the forehearth.

Figure 2:
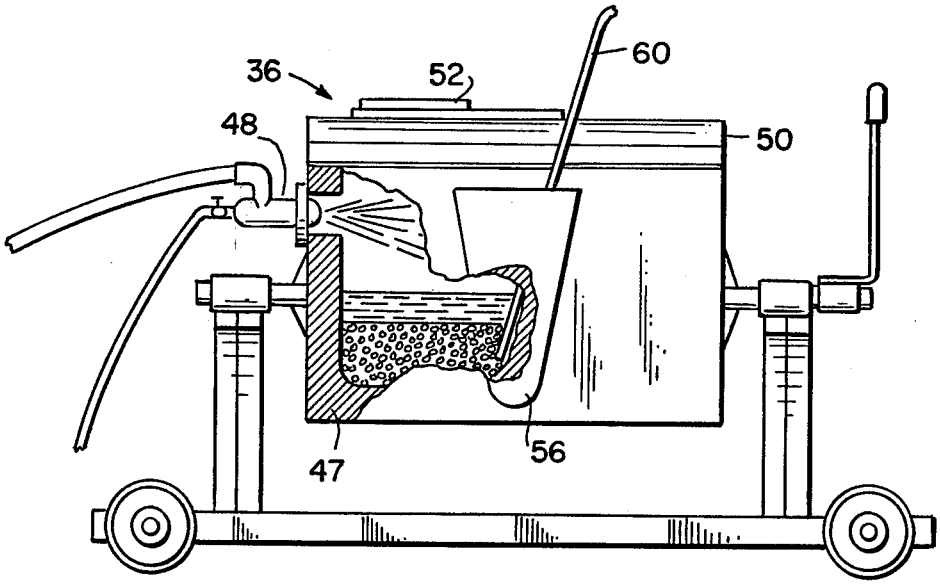
FIG. 2 is a side elevation view, partly in section, of the forehearth used in conjunction with the shaft kiln of FIG. 1.

As shown in FIG. 2, forehearth 36 comprises conventional dumping containers, internally lined with refractory material 47 and provided with conventional displacement means. A conventional burner 48 is provided on one of the walls to maintain the bath temperature. A lid 50 internally lined with refractory material is provided with a conventional gas outlet 52. The forehearth is provided with a drop hole 54, through which the smelted metal coming down the slag tap 34 of the furnace drops, and a tapping hole 56.

Figure 3:
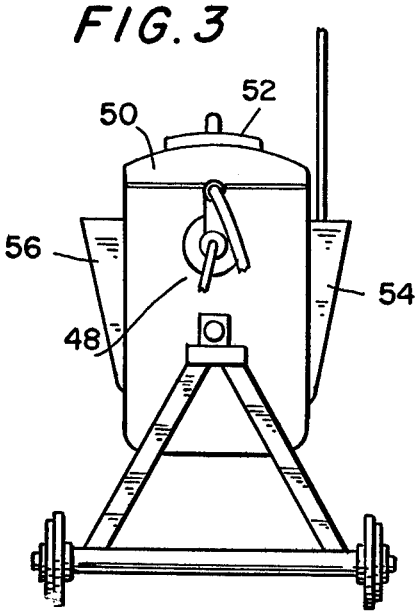
FIG. 3 is an end elevation of FIG. 2.

Forehearths 36 are dumpable for dumping the already refined copper into molds, and are displaceable so that they may be alternated among each other to receive smelted metal from the kiln and likewise in the refining process that is carried out in the forehearth itself. FIG. 2 also depicts the other common elements of displaceable dumping containers, such as burner hoses, chassis, wheels, dumping shaft, handle and so forth. FIG. 3 is an end view of the forehearth that best illustrates the foregoing.

In accordance with the invention, continuous smelting and refining are carried out as follows: The kiln is ignited by conventional methods until it reaches operating temperature, coke being loaded via the loading gate 18. Loading of cement and flux is started on the tray 14 to preheat them. The mixing pallet 22 homogenizes the mix, that drops down the pipe 26 to reach the air feeder 30. Air is compressed by the compressor, carried by pipe 40 and preheated in the coil 38, wherefrom it reaches the air feeder through pipe 32 to enter into tube, that simultaneously receives the mix from the hopper 28. The cement and flux mix is in-blown under pressure together with air through the tube in the intermediate section of the furnace, that is the one having the highest temperature in the incandescent coke column that drops inside the furnace. Experiments carried out indicate the intimate contact of the copper cement with the incandescent coke effects the first reducing phase that eliminates the superficial oxide from the cement, thereby enabling easy smelting of the metal and minimum loss of fines caused by the furnace gas current. In the event of very fine or very old cements, which implies excess oxide, a reducing agent (fine coal, for instance) is added to the mix at the tray 14.

The cement drops in the incandescent coke column, smelts and falls as liquid metal onto the hearth of the kiln. Experience indicates that on passing in front of tuyeres 58 of the furnace, the metal undergoes its first oxidation, therefore the refining process commences in the same furnace in a primary way. The smelted copper reaches the bottom of the hearth, where tapping is carried out continuously with an open tap hole. On leaving the tap hole, contact of liquid copper with the atmosphere continues, and the oxidation reaction started on passing in front of the tuyeres continues.

The liquid metal and the slag fall in the forehearth through the drop hole 34. The bath temperature at the forehearth is maintained by activating the burner 48. Once copper has been accumulated to the extent of ¼ of the total capacity of the forehearth, oxidation of the copper begins. To effect this, the injection nozzle 60 is connected to a hose blowing in air, oxygen, or conventional mixture of the two, thereby originating direct oxidation, controlled under conventional techniques, of the remaining impurities of the metal. The main impurity is iron, and this is captured in the oxidation process by the slag to form silicates. Progress of the oxidation process is determined by sample fracture, according to techniques known to experts, and by conducting periodic flushing to eliminate impurities. In the bath, the liquid copper and the slag are separated by the difference of specific gravity, as known in the art.

Once the forehearth has been filled, it is withdrawn from the furnace and replaced by another that continues to receive the liquid metal from the kiln. All of the slag is removed from the oxidized bath in the forehearth, and a charcoal layer is added. Subsequently, a conventional injection nozzle is introduced, connected to the pipe 46 through which the reduction gas flows under pressure. This is cracked at 800° C. in the coil 42.

Partial cracking of the gas is featured by the short and brilliant flame it reflects, as known to the experts in the art, and which is necessary for the reduction phase that is carried out in the forehearth. This is the final phase of the process according to the invention, and its duration is controlled by conventional sample fractures.

Once the reduction phase is completed, the copper is refined and it is then cast on molds in the ordinary fashion. The forehearth is then free to return under the kiln and, therefore, start a new cycle.

EXAMPLES

During a first phase, tests are carried out to obtain an experimental verification of the smelting process of copper in a shaft kiln, adjust the operation and optimize operating parameters. Only limited loads of copper cement were used, because only one forehearth to receive the smelted copper was available. The following are typical values of this sequence: Loads: 200 kg cement copper, 68 to 80% Cu and 8 to 12% Fe 26 kg $SiO_2$ (13% of the cement load) as flux 13 kg $Na_2CO_3$ (6.5% of the cement load) as flux The furnace operates at a conventional temperature of about 1300° C., which is also maintained in the forehearth by burner 48. The charge preheater was effective to heat the charge to about 100°-120° C., which was satisfactory. Air from coil 38 was preheated to about 600°-700° C.

Flows used were as follows:

cement injector air: 19 to 20 $ft^3$/min pressure 2 $kgr/cm^2$ oxidation air: 8 $ft^3$/min liquified gas (L.P.G.): 0.33 kg/min preheating coke: 35 to 40 kg smelting coke: 50 to 60 kg granulation of coke used: 100% between 2 and 3 inches Times for phases carried out were:

loading smelting in kiln: 50 to 60 min oxidation in forehearth: 15 to 20 min

In the series of tests carried out, reduction was accomplished with poling and gas, with and without preheating.

Times employed in each case are as follows:

Poles = 35 to 45 min

Unheated gas = 30 to 45 min

Heated gas = 4 to 10 min

It was possible to appreciate that on reducing with poles and unheated gas, the endothermic nature of the reaction rapidly cooled the bath. The case was different on reducing with preheated natural gas at approximately 800° C., when it was observed that the bath did not cool off, but in fact increased its temperature. Those skilled in the art will appreciate that the gas system must be purged of air before start-up to avoid explosion hazards.

Pilot experiences showed the following results: Smelting speed was 260 kg/hour of total load. With fresh, high purity cement copper, this smelting speed may represent 220 kg/hour or more of fine copper. Coke rate was 22 to 25% of the total load.

This figure is for the pilot equipment, and a lower coke rate would be expected in an industrial facility. This consumption figure does not include preheating coke for the bed, as this is a fixed quantity.

Copper of 99.9% purity was obtained in a consistent fashion.

Through mass balances, it has been determined that the highest loss was 5% of the copper loaded. This figure may be considered as maximum, inasmuch as there are fractions of the copper obtained that remain embedded in the lining or in splashes that are hard to detect and that, because they represent small volumes peculiar to a pilot operation, have a greater incidence than they would in an industrial operation.

The cost of this process was compared with that of the traditional process used in copper smelters, and it was concluded that the unit cost of the process according to the invention is lower by about one-half. Investment required for the process is much lower than that required for conventional methods, as should be apparent from foregoing description. The process of the invention enables modular equipment to be used, that may be increased in relation to the output desired. Moreover, it produces copper having a higher value added than precipitated copper, and creates benefits insofar as loss on transport and use of freight (smaller load and higher purity).

Allocation of cements to this process increases presently installed smelting capacity, enabling such units to treat higher tonnages of concentrates of copper originating from sulfide ores.

Various changes in the details, steps, materials and arrangements of parts, which have been herein described and illustrated in order to explain the nature of the invention, may be made by those skilled in the art, within the principle and scope of the invention as defined in the appended claims.

What is claimed is:

1. The method of refining cement copper comprising:

mixing cement copper with desired fluxes and preheating the mixture;

injecting the mixture with a heated, pressurized gas into incandescent coke in an oxidizing shaft kiln at the level of highest temperature, to effect rapid melting of said mixture without significant dusting losses and the formation of molten metal and slag phases;

injecting an oxidizing gas into said metal phase to drive impurities into said slag;

removing said slag and covering said metal with a reductant;

treating said metal with a reducing agent to produce a copper of high purity; and recovering said copper.

2. The method as claimed in claim 1, wherein said mixing and preheating are carried out in heat-exchange relation with said shaft kiln.

3. The method as claimed in claim 1, wherein said oxidizing step is carried out with a gas selected from the group consisting of air, oxygen-enriched air and substantially pure oxygen.

4. The method as claimed in claim 1, wherein said fluxes are selected from the group consisting of silica, sodium carbonate, glass, and mixtures thereof.

5. The method as claimed in claim 1, wherein said reductant is charcoal.

6. The method as claimed in claim 1, wherein said reducing agent is a heated hydrocarbon gas.

7. The method as claimed in claim 1, wherein said oxidizing, reducing and recovery steps are carried out in a vessel separate from said shaft kiln.

8. The method as claimed in claim 6, wherein said hydrocarbon is natural gas at about 800° C.

9. The method as claimed in claim 1, wherein said preheated mixture is charged at a point between 45 and 50% of the height of said kiln.

10. The method of substantially continuously refining cement copper comprising:

maintaining a column of incandescent coke in an oxidizing shaft kiln;

continuously charging a preheated mixture of cement copper and desired fluxes into the hottest portion of said column by injection with a heated, pressurized gas;

collecting molten metal and slag phases in a hearth of said kiln and transferring said phases to a forehearth;

injecting an oxidizing gas into said metal to drive impurities into said slag;

replacing said slag with a reductant;

treating said metal with a heated hydrocarbon gas to produce a copper of high purity; and recovering said copper.

11. The method as claimed in claim 10, wherein a single shaft kiln is used in conjunction with a plurality of said forehearths.

12. The method as claimed in claim 10, wherein said oxidizing step is carried out with a free-oxygen containing gas, and said hydrocarbon is a natural gas at about 800° C.

* * * * *